US005757274A

United States Patent [19]

Slomowitz et al.

[11] Patent Number: 5,757,274

[45] Date of Patent: May 26, 1998

[54] CRIB GATE POSITION INDICATOR

[76] Inventors: Cynthia J. Slomowitz; Scott M. Slomowitz, both of 2603 Tonbridge Dr., Wilmington, Del. 19810

[21] Appl. No.: 784,662

[22] Filed: Jan. 21, 1997

Related U.S. Application Data

[63] Continuation-in-part of Ser. No. 524,006, Sep. 1, 1995, Pat. No. 5,629,683.

[51] Int. Cl.[6] ..... G08B 23/00

[52] U.S. Cl. ..... 340/573; 340/539; 340/556; 340/686

[58] Field of Search ..... 340/686, 573, 340/575, 545, 555, 556, 539, 691, 331, 332, 521, 522; 381/110, 56; 128/903

[56] References Cited

U.S. PATENT DOCUMENTS

| | | | |
|---|---|---|---|
| 2,734,104 | 2/1956 | Gollhofer | 340/686 X |
| 4,231,030 | 10/1980 | Weiss | 340/686 |
| 4,640,267 | 2/1987 | Lawson | 128/898 |
| 4,951,032 | 8/1990 | Langsam | 340/686 |
| 5,022,402 | 6/1991 | Schieberl et al. | 128/671 |
| 5,057,819 | 10/1991 | Valenti | 340/573 |
| 5,210,532 | 5/1993 | Knoedler et al. | 340/573 X |
| 5,280,635 | 1/1994 | Knoedler et al. | 455/128 |
| 5,291,181 | 3/1994 | DePonte | 340/573 |
| 5,512,880 | 4/1996 | Abrams et al. | 340/573 |
| 5,629,683 | 5/1997 | Slomowitz et al. | 340/686 |

FOREIGN PATENT DOCUMENTS

| | | | |
|---|---|---|---|
| 3034968 | 4/1982 | Germany | 340/573 |
| 3204827 | 8/1983 | Germany | 340/573 |

OTHER PUBLICATIONS

Bishop, "BabyCom", *Practical Electronics*, pp. 24–27, Nov. 1979.

*Primary Examiner*—Thomas Mullen

*Attorney, Agent, or Firm*—Caesar, Rivise, Bernstein, Cohen & Pokotilow, Ltd.

[57] ABSTRACT

A crib gate position indicator for use with a baby crib to automatically alert the parent or infant-caretaker, who is at a location outside of the room or location of the baby crib, when the crib gate has been left in an open condition. Other variations of this crib gate position indicator are used in conjunction with a baby monitoring system, thus supplementing a baby monitoring system with the ability to provide a crib gate position indication, in addition to permitting the parent or infant-caretaker to listen to the sounds being made by the baby.

17 Claims, 9 Drawing Sheets

CRIB GATE POSITION INDICATOR

FIELD OF THE INVENTION

This application is a Continuation-in-Part of application Ser. No. 08/524,006 filed Sep. 1, 1995, now U.S. Pat. No. 5,629,683 entitled CRIB GATE POSITION INDICATOR and whose disclosure is incorporated by reference herein.

This invention relates generally to indicators and, more particularly, to electronic position indicators for the gate of a crib.

BACKGROUND OF THE INVENTION

Most baby cribs comprise a mattress located within a bed frame having four sides, with each side comprising vertical bars positioned between a top molding and a bottom molding. Two opposing sides are vertically displaceable, known as a crib gate, in either a raised (closed) condition or in a lowered (open) position. Lowering the gate is accomplished by displacing a footbar (located at the bottom and just under the bottom molding) which disengages a bottom molding catch from the footbar and then allows the gate to drop downward. Raising the gate is accomplished by simply lifting the gate upwards until the bottom molding catch re-engages the footbar, thereby locking the gate in a raised position.

In most instances, the parent or infant-caretaker will be holding or rocking the baby to sleep. When the parent or infant-caretaker is ready to place the baby on the mattress, the gate is lowered as discussed previously. Usually, the parent or infant caretaker is so focused on positioning the infant on the mattress without waking the infant that frequently the parent or infant-caretaker forgets to raise the gate after the infant is placed on the mattress. The result is that the infant is left in a crib with the gate down. If the infant is old enough to roll and raise himself/herself, the infant could fall out of the crib at a later time because the crib gate remains in an open condition.

The following U.S. patents disclose some form of indication or warning in association with a baby crib or bed.

U.S. Pat. No. 2,734,104 (Gollhofer) discloses an alarm for alerting an attendant that the crib gate is in a down position.

U.S. Pat. No. 4,231,030 (Weiss) discloses a safety device for a crib that provides an indicating light or an alarm at the crib to alert a person to the fact that the crib gate is in a down position.

U.S. Pat. No. 4,951,032 (Langsam) discloses a crib rail safety monitor that utilizes a weight sensor for detecting the presence of a child in the crib and an ultrasonic motion detector or infrared temperature sensor for detecting the presence of an attendant at the crib in order to provide an indication or alarm at the crib that the crib gate is down when the child is in the crib and is unattended.

U.S. Pat. No. 5,057,819 (Valenti) discloses a safety cushion device that is positioned on the floor adjacent the baby crib for cushioning the fall of a child and an alarm for alerting an adult of such a fall.

U.S. Pat. No. 5,291,181 (DePonte) discloses a wet bed alarm and temperature monitoring system for detecting urine on the bed and the temperature of a person lying on the bed and for supplying a remote annunciator panel with such information.

Therefore, there remains a need to provide the parent or infant-caretaker with an automatic remotely-located indication or warning of the crib gate position.

OBJECTS OF THE INVENTION

Accordingly, it is the general object of this invention to provide a crib gate position indicator that overcomes the disadvantages of the prior art.

It is a further object of this invention to provide a crib gate position indicator that automatically informs the parent or infant-caretaker that the crib gate is open.

It is yet a further object of this invention to provide a crib gate position indication to a parent or infant-caretaker at a location outside the room of the crib.

It is a further object of one aspect of this invention to provide a crib gate position indicator that generates a gate open indication without the need for the parent or infant-caretaker to manually enable/disable some indication apparatus.

It is yet another object of this invention to provide a crib gate position indicator that is easy to install on existing cribs.

It is still a further object of this invention to provide a crib gate position indicator that has no wires within reach of the infant when the infant is in the crib.

It is still yet a further object of this invention to provide a crib gate position indicator that can be used in conjunction with a baby monitoring system.

SUMMARY OF THE INVENTION

These and other objects of the instant invention are achieved an apparatus for providing an automatic crib gate position indication of a crib having a gate that can be positioned in an open or a closed condition. The apparatus comprises a gate sensor means, having a transmitter, coupled to the crib that wirelessly transmits a first signal indicative of the open condition to a baby monitoring system. The baby monitoring system includes a baby unit adjacent the crib and a parent unit remotely-located from the crib and whereby the baby unit wirelessly transmits a second signal indicative of the baby sounds that is received by the parent unit. The first signal is also received by the parent unit and controls a crib gate indication means therein.

Another embodiment of this invention includes an apparatus for providing an automatic crib gate position indication of a crib having a gate that can be positioned in an open or a closed condition. The apparatus comprises a gate sensor means, having a transmitter, coupled to the crib that wirelessly transmits a first signal indicative of the open condition to a baby monitoring system. The baby monitoring system includes a baby unit adjacent the crib and a parent unit remotely-located from the crib and whereby the baby unit includes a receiver for receiving the first signal and whereby the baby unit generates a second signal indicative of baby sounds sensed by the baby unit. The first signal is embedded into the second signal, by a modulation means in the baby unit coupled to the receiver, to form a composite signal that is wirelessly transmitted to, and received by, the parent unit. The composite signal is used to control a crib gate indication means in the parent unit.

Finally, another embodiment of this invention includes an apparatus for use with a baby crib having a displaceable gate that can be positioned in an open condition or in a closed condition, whereby the apparatus provides an automatic, remotely-located indication of the condition of the gate. The apparatus comprises a gate sensor means, coupled to the crib, including a transmitter for wirelessly transmitting a gate indication signal representative of the open condition of the gate. The apparatus further comprises a remotely-located receiver including an indication means whereby the remotely-located receiver receives the gate indication signal and the gate indication signal controls the activation of the indication means. The apparatus also comprises a remotely-located enabling means whereby the enabling means enables the gate sensor means whenever a person (e.g., parent or infant caretaker) moves into the vicinity of the crib. In addition, the remotely-located enabling means and the remotely-located receiver are positioned at respective locations remote from the crib.

DESCRIPTION OF THE DRAWINGS

Other objects and many of the attendant advantages of this invention will be readily appreciated as the same becomes better understood by reference to the following detailed description when considered in connection with the accompanying drawings wherein.

DESCRIPTION OF THE PREFERRED EMBODIMENT OF THE INVENTION

Figure 1:
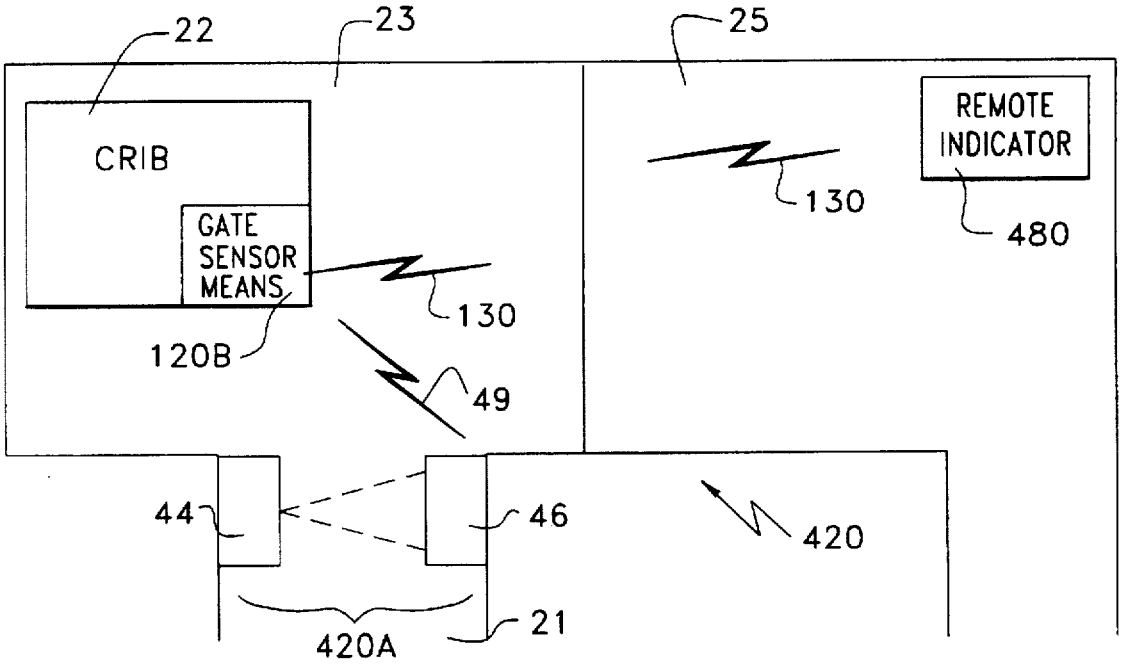
FIG. 1 is a top plan view of a home showing the location of the present invention.
Figure 2:
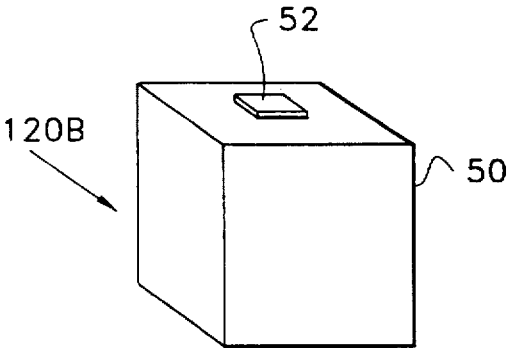
FIG. 2 is an enlarged isometric view of the gate sensor means shown in FIG. 1.
Figure 4:
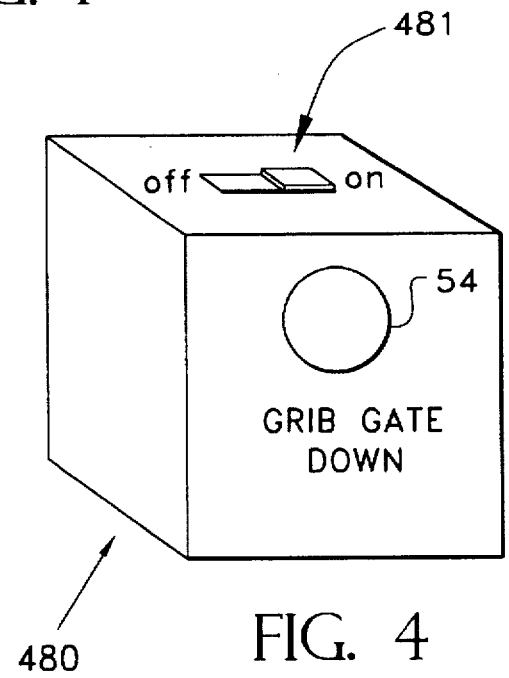
FIG. 4 is an isometric view of the remotely-located indicator as shown in FIG. 1.

Referring now in greater detail to the various figures of the drawing wherein like reference characters refer to like parts, there is shown generally at 420 in FIG. 1 a crib gate position indicator constructed in accordance with this invention. The crib gate position indicator 420 comprises a gate sensor means 120B (identical to the gate sensor means 120B of application Ser. No. 08/524,006) coupled to a crib 22 (FIG. 3), a remotely-located enabling means 420A at a doorway 21 and a remotely-located indicator 480 which comprises the indication means 54 of application Ser. No. 08/524,006. As shown in FIG. 1, the crib 22 with the gate sensor means 120B coupled thereto are located in the baby's room 23 with the remotely-located enabling means 420A located at the doorway 21 of the baby's room 23. The remotely-located indicator 480 is located in another room 25, e.g., the parent's bedroom, not necessarily adjacent the baby's room 23. Thus, the crib gate position indicator 420 provides for the indication of the position of the crib gate 26 to be located outside of the baby's room 23.

In particular, operation of the gate sensor means 120B (FIG. 7) is identical to that disclosed in application Ser. No. 08/524,006 and thus will not be repeated here.

Figure 6:
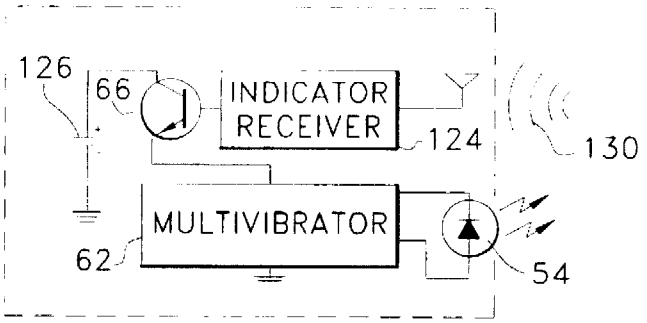
FIG. 6 is block diagram of the remotely-located indicator.

The remotely-located enabling means 420A (FIG. 5) is similar to the remotely-located enabling means 120A of application Ser. No. 08/524,006, except that the remotely-located enabling means 420A does not include the indication means 54, the indicator receiver 124, the battery 126, the transmitter 66 nor the multivibrator 62. Instead, these five devices are located in the remotely-located indicator 480, as shown in FIG. 6. It should be understood that with the battery 126 located in the remotely-located indicator 480, power to the photoemitter 44 of the remotely-located enabling means 420A can be AC power from a wall socket (not shown) or from another internal battery (also not shown).

Figure 5:
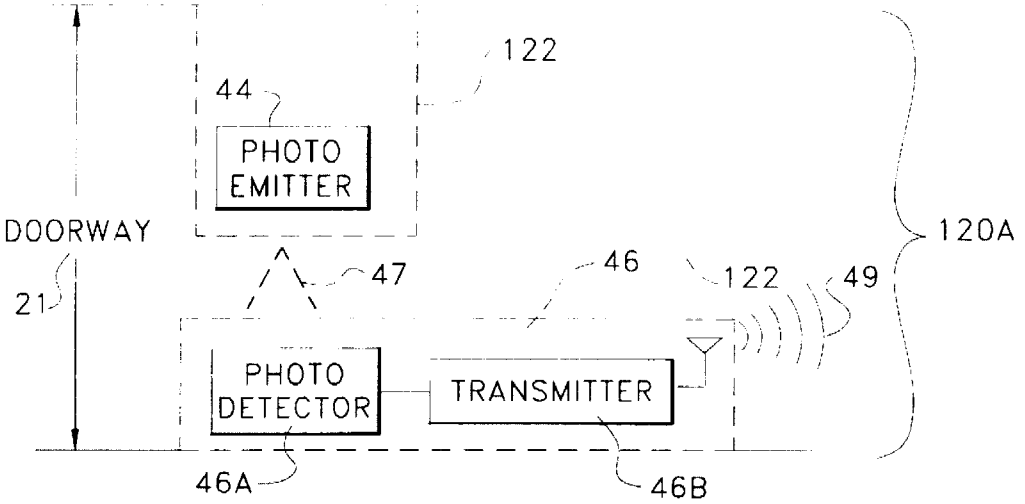
FIG. 5 is a top view of the doorway of FIG. 1 showing a block diagram/schematic of the remotely-located enabling means.
Figure 7:
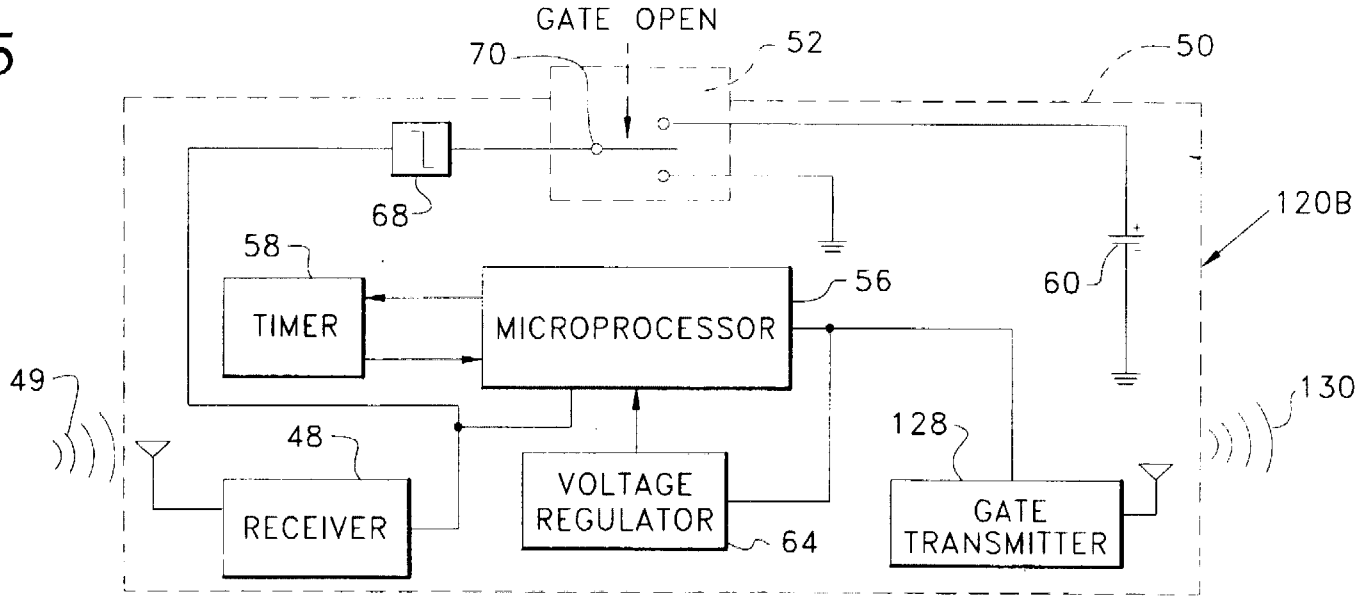
FIG. 7 is a block diagram of the gate sensor means.

As shown in FIGS. 5–7, operation of the crib gate position indicator 420 is as follows. In accordance with application Ser. No. 08/524,006, when the enabling means 420A is activated by a parent or infant-caretaker passing between the photoemitter 44 and the photodetector 46A, a signal 49 is generated by the transmitter 46B that is received by the receiver 48 in the gate sensor means 120B, thus enabling the gate sensor means 120B. Once powered, the microprocessor 56 implements the program shown in FIG. 8. In particular, the microprocessor 56, controls the activation of the gate transmitter 128. The gate transmitter 128, when activated by the microprocessor 56, emits a signal 130 that is received by the indicator receiver 124 in the remotely-located indicator 480 in the other room 25. The indicator receiver 124 turns on the transistor 66 which permits the multivibrator 62 to be energized and the indication means 54 begins flashing. If either the crib gate 26 is closed or if the timer 58 reaches the predetermined period before the crib gate 26 is closed, the microprocessor 56 de-activates the gate transmitter 128. When the gate transmitter 128 is de-activated, the indicator receiver 124 no longer receives the signal 130 and therefore turns off the transistor 66, thereby shutting off the indication means 54.

Power for the remotely-located indicator 480 is provided by the battery 126 or AC power from a wall socket (not shown). An on/off switch 481 permits the parent or infant-caretaker the ability to conserve power when the indicator 480 is not in use.

It is contemplated by the Applicants that the gate transmitter 128/indicator receiver 124 portion include logic for appending additional changeable coded information on the signal 130 sent between them which can be employed to prevent interference between the use of the transmitter 128 and baby monitors, garage door openers, window alarms, etc., in the area which might be affected thereby.

Figure 9:
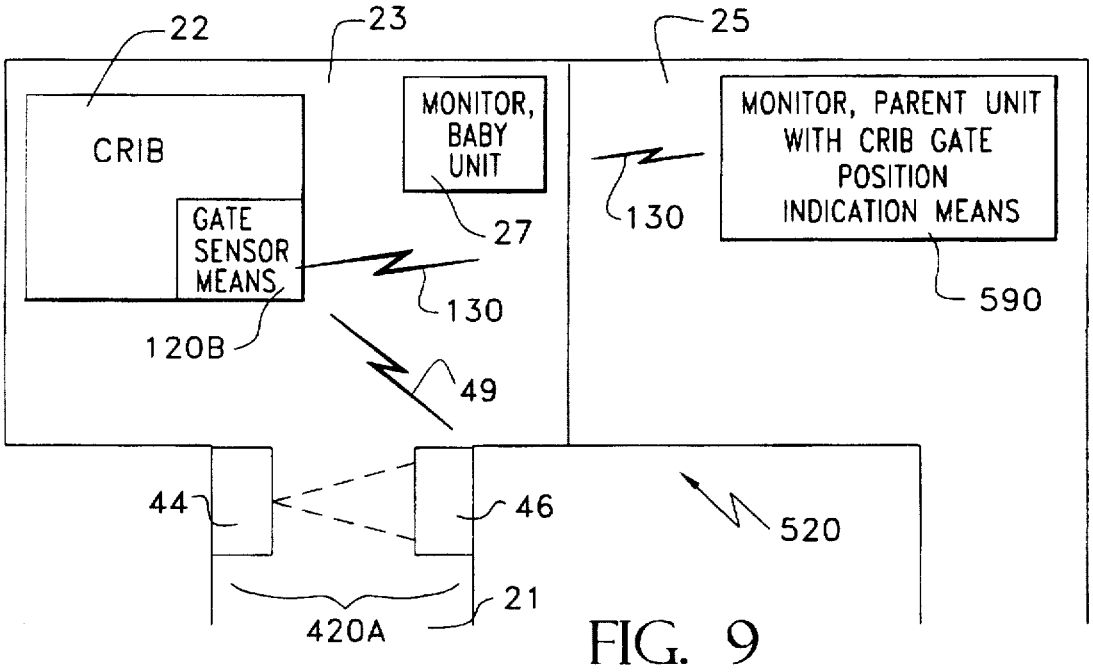
FIG. 9 is a top plan view of a home showing the location of a second embodiment of the present invention.
Figure 10:
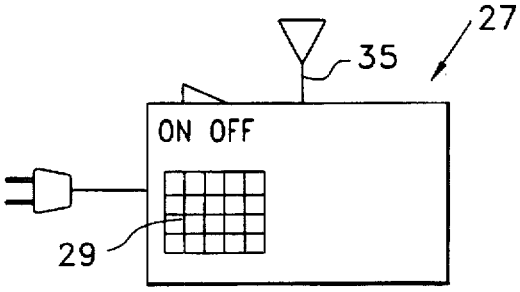
FIG. 10 PRIOR ART
FIG. 10 is side elevational view of a conventional baby unit of a baby monitoring system.
Figure 11:
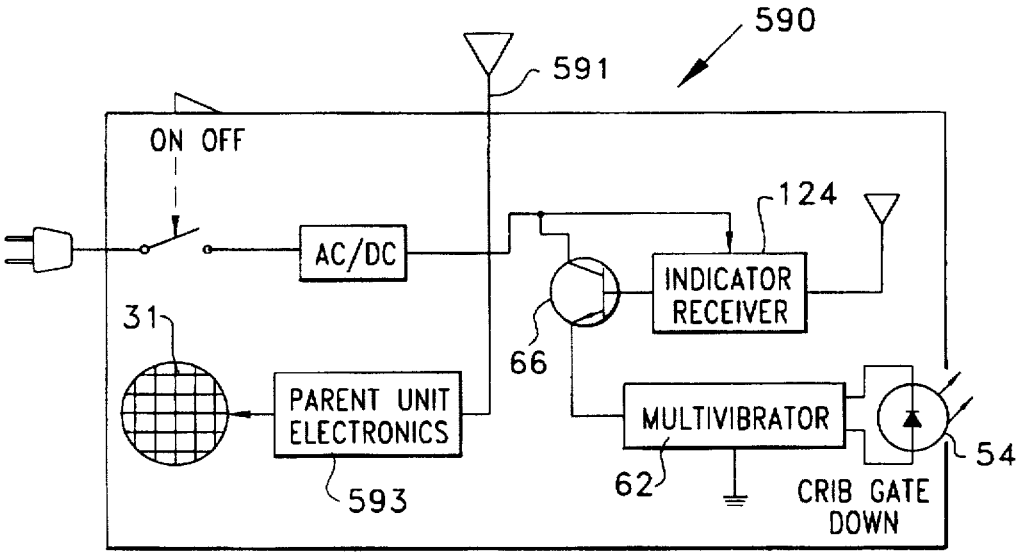
FIG. 11 is a side elevational view of a conventional parent unit of the baby monitoring system of FIG. 10 that has been modified to include the crib gate position indication means.

A second embodiment of the present invention is shown at 520 in FIG. 9. The crib gate position indicator 520 is identical to the crib gate position indicator 420, except that the remotely-located indicator 480 has been replaced with a parent unit 590 of a baby monitoring system which has been adapted to support the indication means 54. In particular, as shown in FIGS. 10 and 11, a baby monitoring system comprises a baby unit 27 (FIG. 10) and a parent unit 590 (FIG. 11). The baby unit 27 comprises a microphone 29 and electronics 33 having a transmitter (not shown) such that when the baby unit 27 is powered and placed in the vicinity of the crib 22, a wirelessly-transmitted signal (also not shown) of the baby's condition (e.g., breathing, talking, movement, other baby sounds, etc.) is emitted from the baby unit antenna 35 and is available for receipt by a remotely-located parent unit 590. The parent unit 590 comprises an antenna 591 and electronics 593 having a receiver (not shown) and a speaker 31 for receiving the wirelessly-transmitted signal (hereinafter known as the "baby monitor signal") and converting it back into an audible signal for the parent or infant-caretaker to monitor. The parent unit 590 can be located in any other room 25, which is not necessarily an adjacent room.

In the crib gate position indicator 520, the baby unit 27 is a conventional baby unit of a baby monitoring system which operates independent of the crib gate position indicator 520. However, the parent unit 590 comprises a conventional parent unit of that baby monitoring system that has been adapted to include the indicator receiver 124, the multivibrator 62, the transistor 66 and the indication means 54, as shown in FIG. 11; the battery 126 is optional since power to the transistor 66 and the indicator receiver 124 can be obtained from the power supply of the parent unit 590. Thus, when the parent or infant-caretaker turns on the parent unit 590 in the other room 25, the crib gate position indicator 520 is fully operational. Operation of the crib gate position indicator 520 is similar to the crib gate position indicator 420.

It is contemplated by the Applicants that the gate transmitter 128/indicator receiver 124 portion include logic for appending additional changeable coded information on the signal 130 sent between them which can be employed to prevent interference between the use of the gate transmitter 128 and the baby monitor signal or other wireless devices (e.g., garage door openers, window alarms, etc.) in the area which might be affected thereby.

Figure 12:
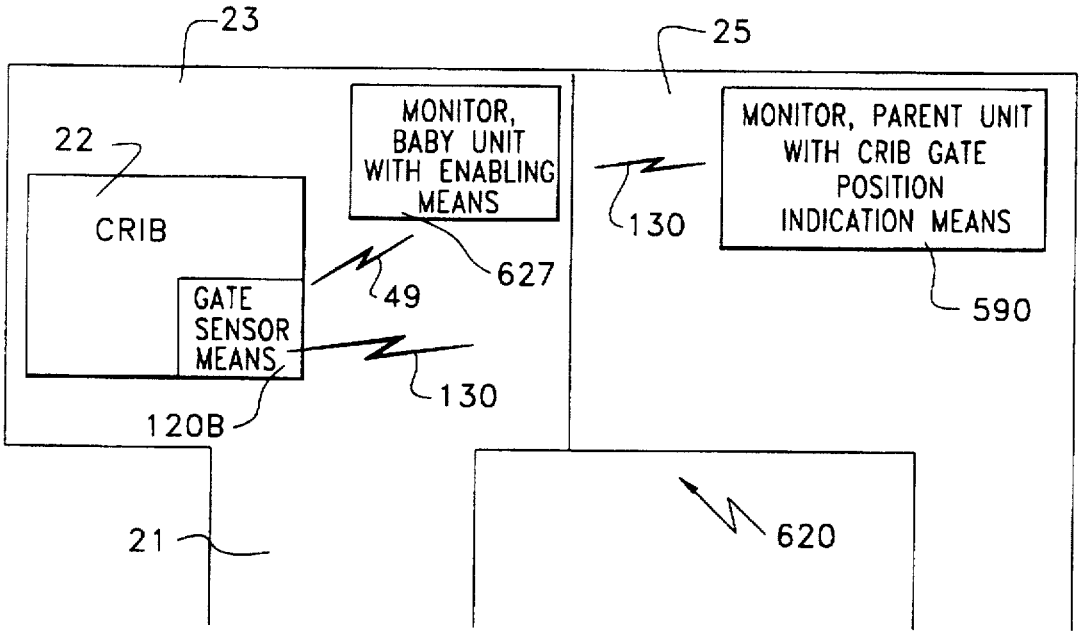
FIG. 12 is a top plan view of a home showing the location of a third embodiment of the present invention.

A third embodiment of the present invention is shown at 620 in FIG. 12. The crib gate position indicator 620 does not use the remote enabling means 420A. Rather, a different remote enabling means 620A is incorporated into the baby unit 627 of a baby monitoring system. The crib gate position indicator 620 comprises the gate sensor means 120B and the parent unit 590. Thus, the baby unit 627 and the parent unit 590 form a conventional baby monitoring system that have been modified so that baby unit 627 comprises the remote enabling means 620A and the parent unit 590 comprises the remote indication means 54.

Figure 8:
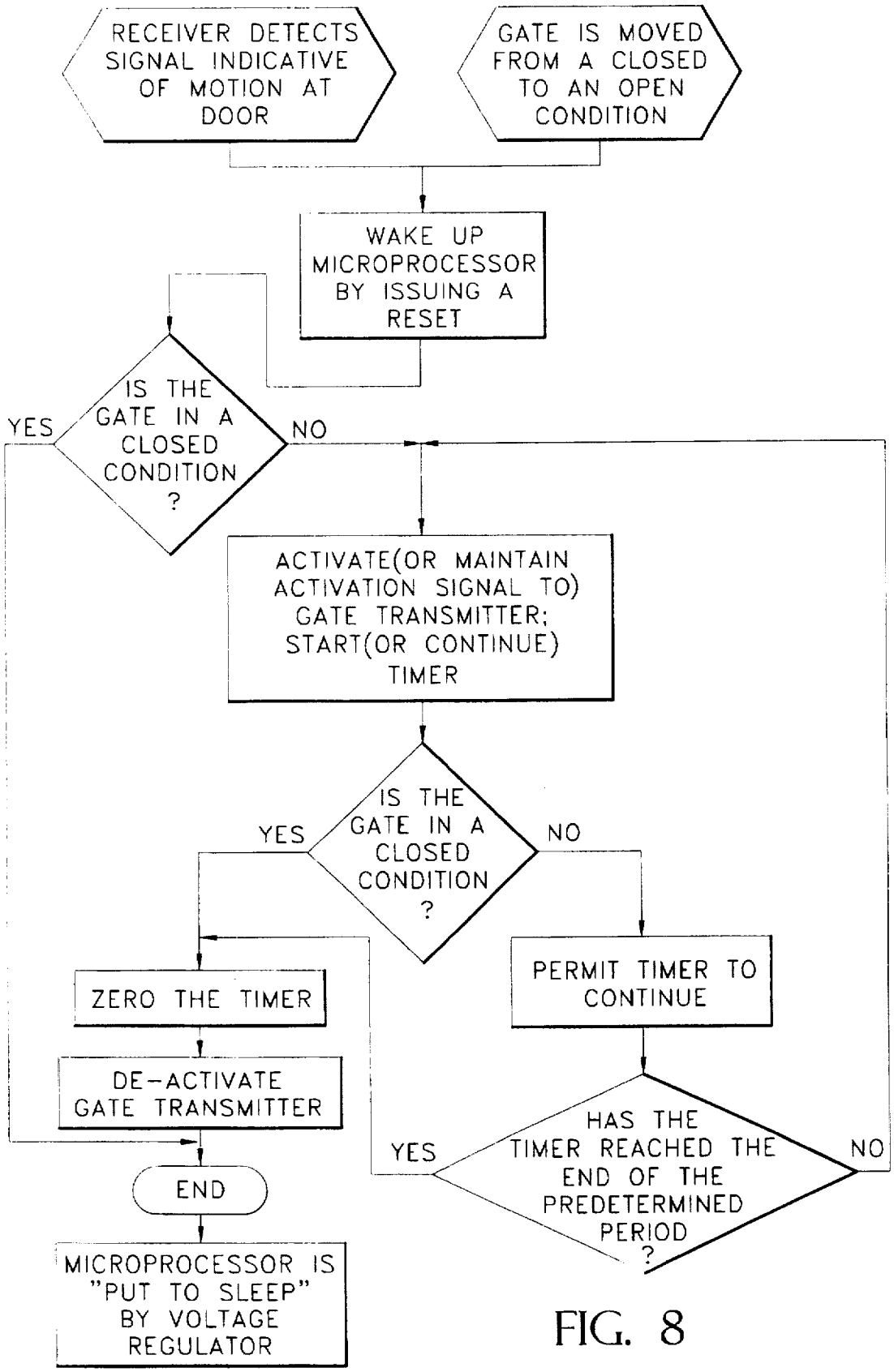
FIG. 8 is a flow chart showing the operation of the present invention and which operation is accomplished under the control of a microprocessor with suitable software.

To be consistent with this different remote enabling means 620A, the block in FIG. 8 labeled "RECEIVER DETECTS SIGNAL INDICATIVE OF MOTION AT DOOR" is replaced with "RECEIVER DETECTS SIGNAL INDICATIVE OF BABY UNIT BEING TURNED ON".

Figure 13:
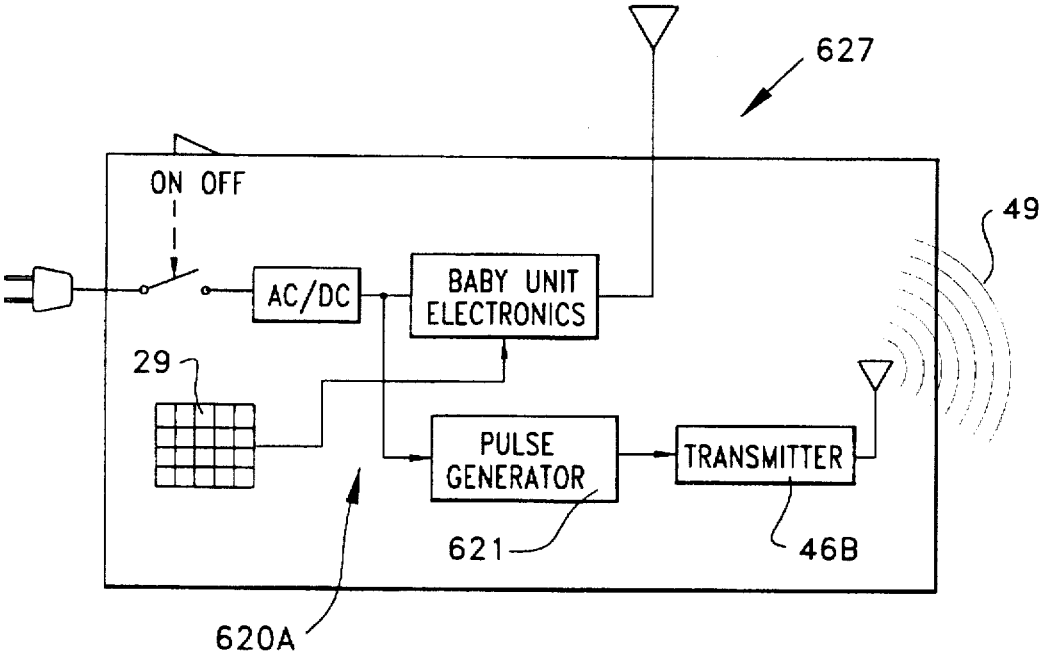
FIG. 13 is a block diagram of a conventional baby unit of a baby monitoring system of FIG. 12 that has been modified to include a remote enabling means.

As shown in FIG. 13, the remote enabling means 620A comprises the transmitter 46B that is coupled to the ON/OFF switch of the baby unit 627 through a pulse generator 621. Thus, when the baby unit 627 is turned on by the parent or infant-caretaker, the pulse generator 621 sends a pulse to momentarily energize the transmitter 46B which immediately emits the enabling signal 49 for receipt by the gate sensor means 120B. Thus, only one enabling signal 49 is emitted when the baby unit 627 is turned on. As such, it should be understood that the enabling signal 49 is a momentary, not continuous, signal. Once the enabling signal 49 is sent, depending on the condition of the crib gate 26, the indication means 54 in the parent unit 590 located in the other room 25 will flash or remain off, in accordance with application Ser. No. 08/524,006.

Because the remote enabling means 620A is part of the baby unit 627, there is no longer any detection of the approach of the parent or infant-caretaker into the vicinity of the crib 22 as occurs with the remote enabling means 420A. Should the crib gate 26 be opened during the night by the parent or infant-caretaker, the falling edge detector 68 (FIG. 7) in the gate sensor means 120B detects this opening and causes the indication means 54 in the parent unit 590 in the other room 25 to flash.

As with the crib gate position indicator 520, it is contemplated by the Applicants that the gate transmitter 128/indicator receiver 124 portion include logic for appending additional changeable coded information on the signal 130 sent between them which can be employed to prevent interference between the use of the gate transmitter 128 and the baby monitor signal or other wireless devices (e.g., garage door openers, window alarms, etc.) in the area which might be affected thereby.

Figure 14:
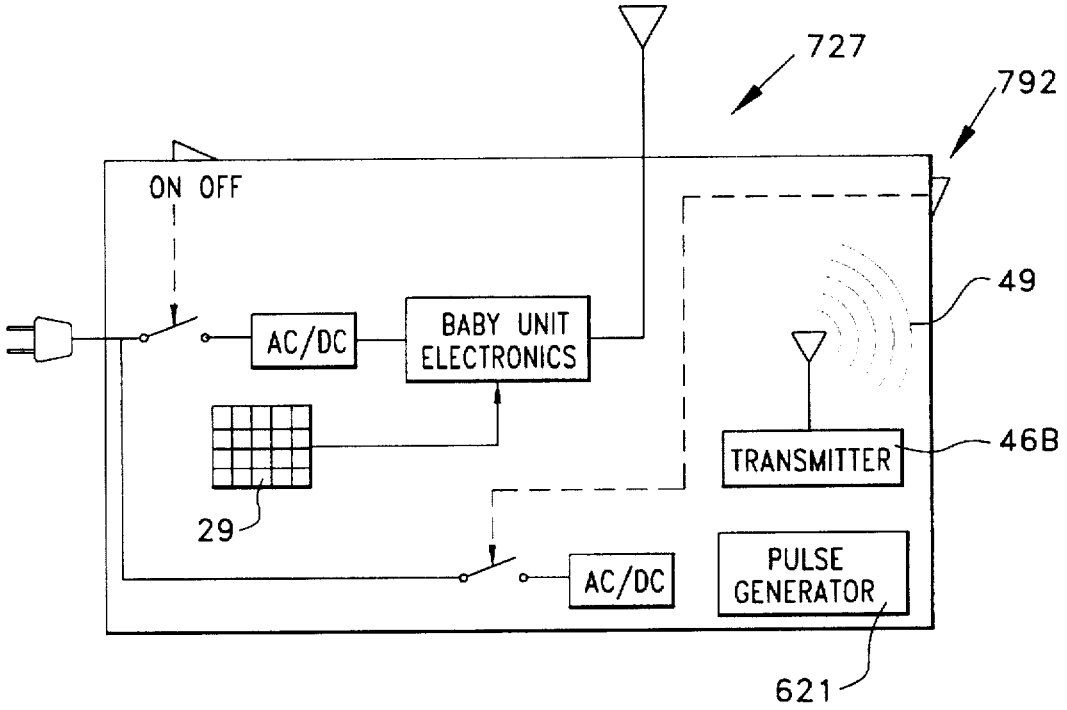
FIG. 14 is a block diagram of the baby unit of FIG. 13 that has been modified to incorporate a power switch for the remote enabling means.
Figure 15:
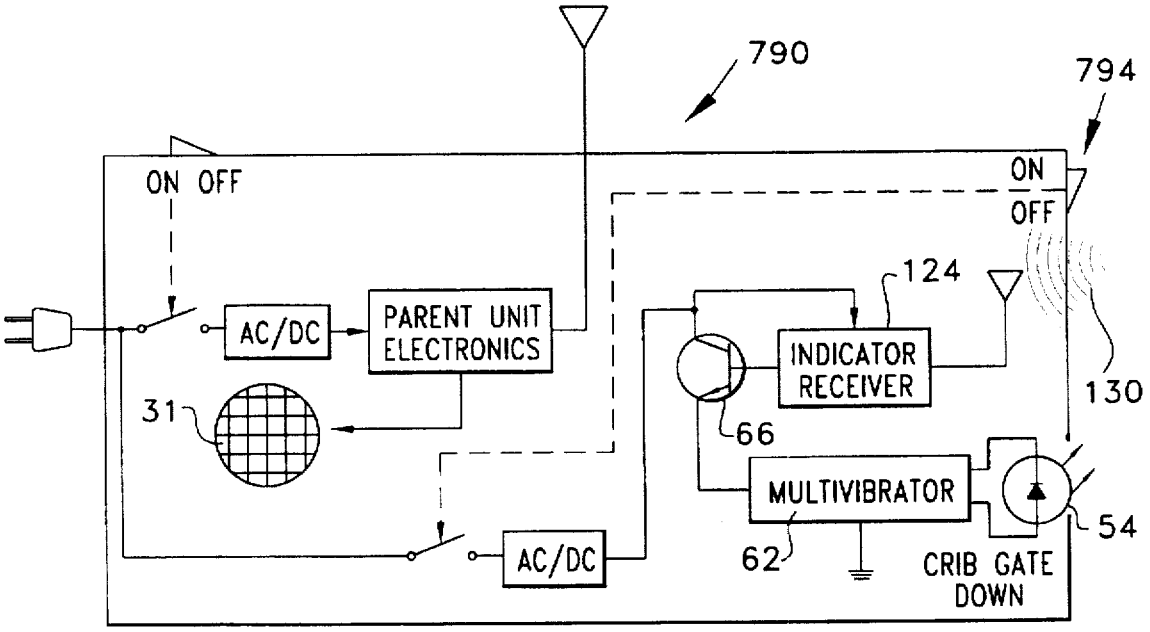
FIG. 15 is a block diagram of the parent unit of FIG. 11 that has been modified to incorporate a power switch for the indication means.

A variation of the third embodiment 620 replaces the baby unit 627 with a baby unit 727 (FIG. 14) and replaces the parent unit 590 with a parent unit 790 (FIG. 15). To that end, the baby unit 727 differs from the baby unit 627 only in that there is a separate ON/OFF switch 792 from the baby unit's 627 conventional on/off switch. Similarly, the parent unit 790 differs from the parent unit 590 only in that there is a separate ON/OFF switch 794 from the parent unit's 590 conventional on/off switch. Thus, using the baby unit 727 and the parent unit 790, a combination of a baby monitoring system and a crib gate position indicator 620 is implemented when the baby unit's 727 conventional power switch and switch 792 are ON and when the parent unit's 790 conventional power switch and the switch 794 are also ON. Alternatively, when the baby unit's 727 conventional power switch is OFF and the switch 792 is ON and when the parent unit's 790 conventional power switch is OFF and the switch 794 is ON, these units 727/790 are being used strictly as the crib gate position indicator 620.

To be consistent with the use of additional switch 792 on the baby unit 727, the block in FIG. 8 labeled "RECEIVER DETECTS SIGNAL INDICATIVE OF MOTION AT DOOR" is replaced with "RECEIVER DETECTS SIGNAL INDICATIVE OF SWITCH 792 BEING TURNED ON".

Figure 16:
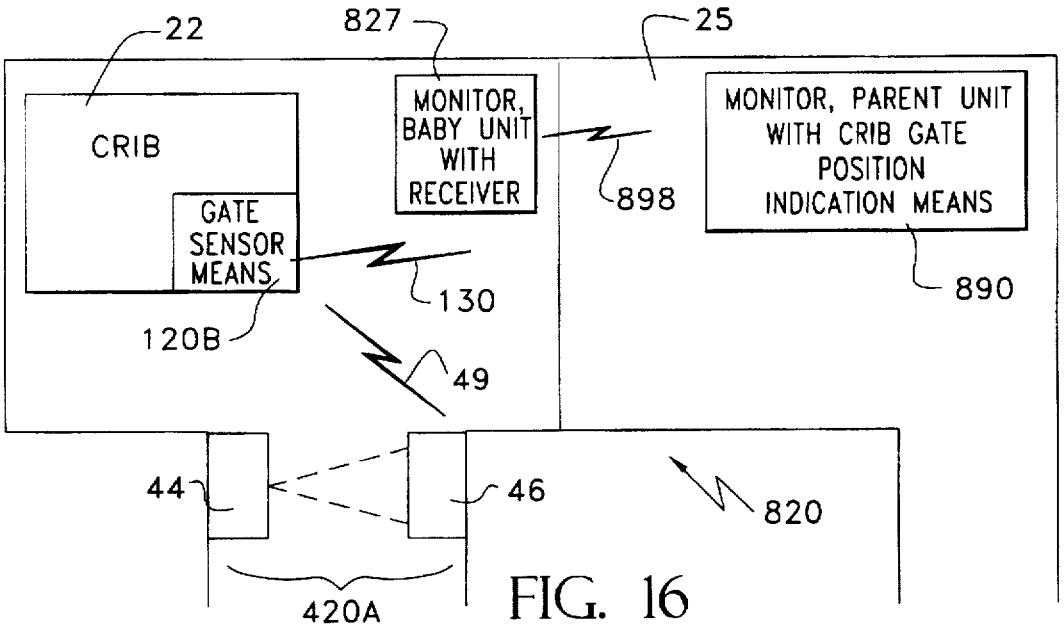
FIG. 16 is a top plan view of a home showing the location of a fourth embodiment of the present invention.
Figure 17:
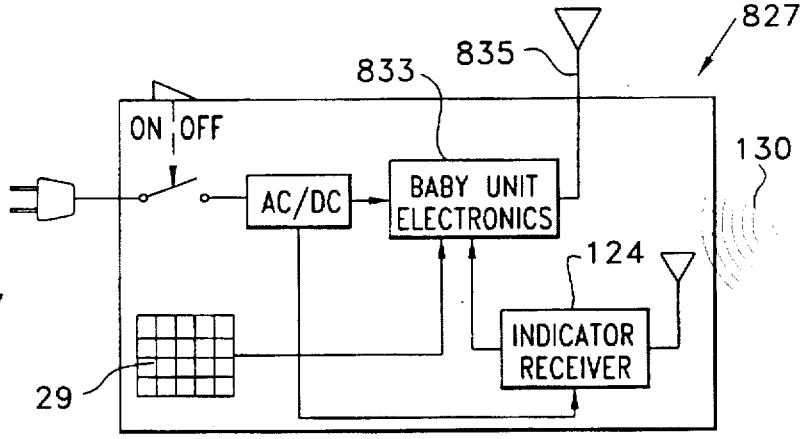
FIG. 17 is a block diagram of the baby unit with a receiver of FIG. 16.
Figure 18:
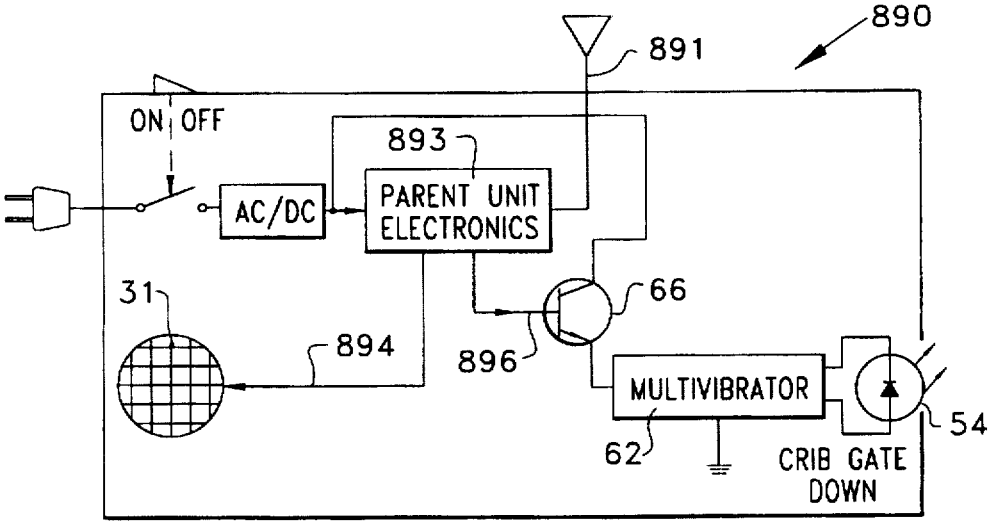
FIG. 18 is a block diagram of the parent unit having the indication means of FIG. 16.

A fourth embodiment of the present invention is shown at 820 in FIG. 16. The crib gate position indicator 820 comprises the remote enabling means 420A, the gate sensor means 120B, a baby unit 827 and a parent unit 890. To that end, the baby unit 827 comprises the receiver 124 for receiving the signal 130. In addition, the baby unit 827 comprises electronics 833 having a modulation means (not shown) for embedding the signal 130 into the baby monitor signal forming a composite signal 898 that is emitted from a baby unit antenna 835 for receipt by the remotely-located parent unit 890. The parent unit 890 comprises an antenna 891 and electronics 893 having a receiver (not shown) including a demodulation means (also not shown) for receiving the composite signal 898 and demodulating the composite signal 898 into an audible signal of the baby's condition (e.g., breathing, talking, movement, etc.) on line 894 to the speaker 31 and into an activation signal representative of the signal 130 (if present in the composite signal 898) on line 896 for activating the indication means 54. In other words, the baby unit 827 and the parent unit 890 operate in the conventional baby monitoring system manner, except that embedded in the baby monitor signal is the signal 130 (together the baby monitor signal and the signal 130 form the composite signal 898) if the crib gate 26 is down, thereby causing the indication means 54 in the parent unit 890 to flash; if the crib gate 26 is up, then the composite signal 898 simply comprises the baby monitor signal and, hence, there is no signal 130.

The modulation means in the baby unit 827 can be any conventional modulation means used in the wireless transmission of a typical baby monitor signal with the added ability to further modulate the carrier signal (e.g., 900 MHz) with the signal 130 when present. Similarly, the demodulation means in the parent unit 890 can be any conventional demodulation means used in the reception of a wirelessly-transmitted baby monitor signal with the added ability to further demodulate the received baby monitor signal into the embedded signal 130 when present.

Figure 19:
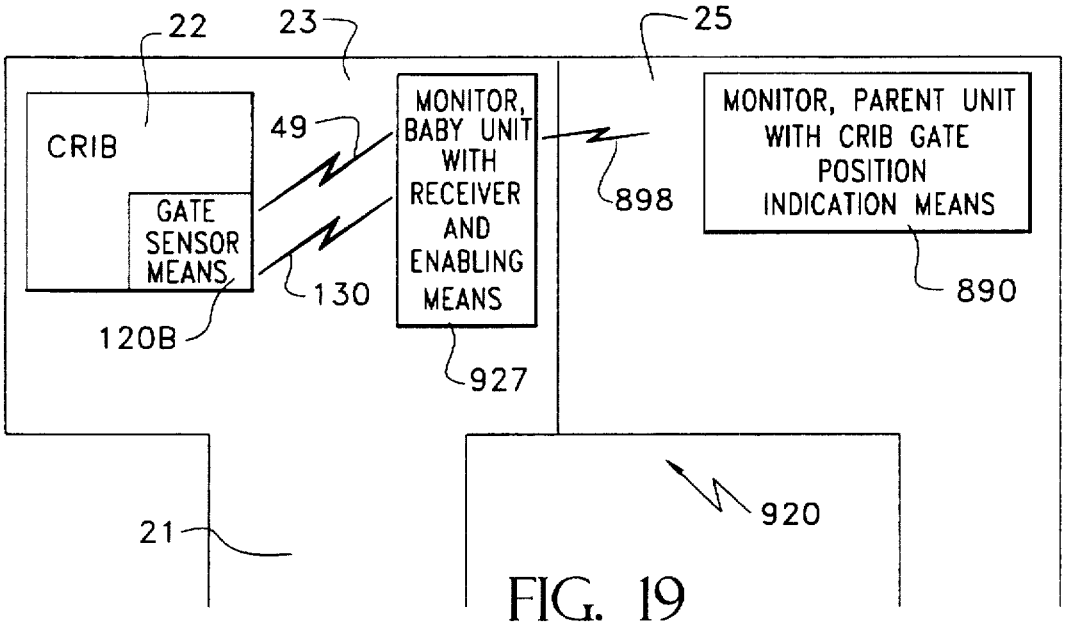
FIG. 19 is a top plan view of a home showing the location of a fifth embodiment of the present invention.
Figure 20:
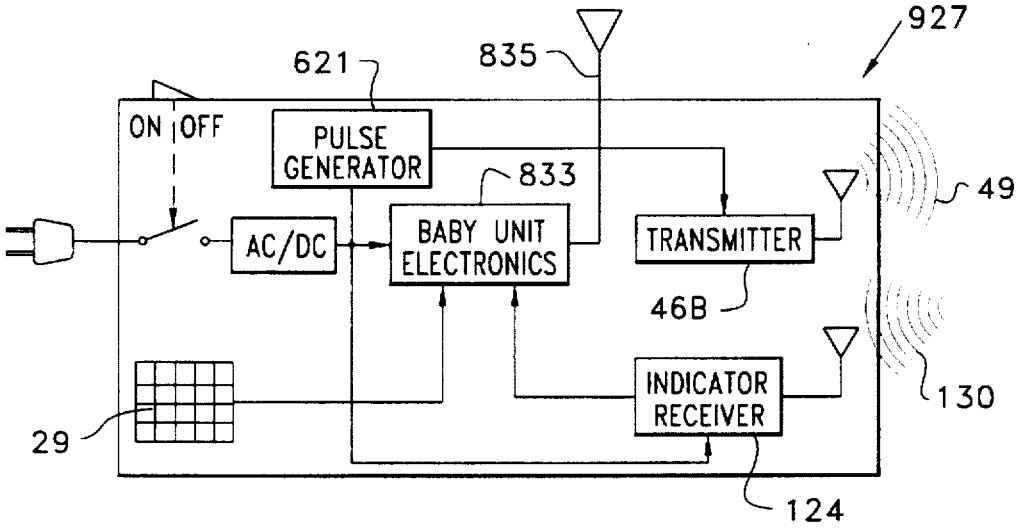
FIG. 20 is a block diagram of the baby unit with an enabling means and a receiver of FIG. 19.

A fifth embodiment of the present invention is shown at 920 in FIG. 19. The crib gate position indicator 920 comprises the remote enabling means 620A, the gate sensor means 120B, a baby unit 927 and a parent unit 890. To that end, the baby unit 927 comprises the transmitter 46B that is coupled to the ON/OFF switch of the baby unit 927. Thus, when the baby unit 927 is turned on by the parent or infant-caretaker, the transmitter 46B immediately emits the enabling signal 49 for receipt by the gate sensor means 120B. The baby unit 927 also comprises the receiver 124 for receiving the signal 130. In all other respects, the baby unit 927 is similar to the baby unit 827 and thus operates in accordance with the baby unit 827 of the crib gate position indicator 820. The crib gate position indicator 920 uses the parent unit 890 which operates as described previously with respect to the crib gate position indicator 820.

As disclosed in application Ser. No. 08/524,006, it is within the broadest scope of these inventions 420–820 to have the gate sensor means 120B be compatible with a variety of displaceable gate cribs.

Figure 21:
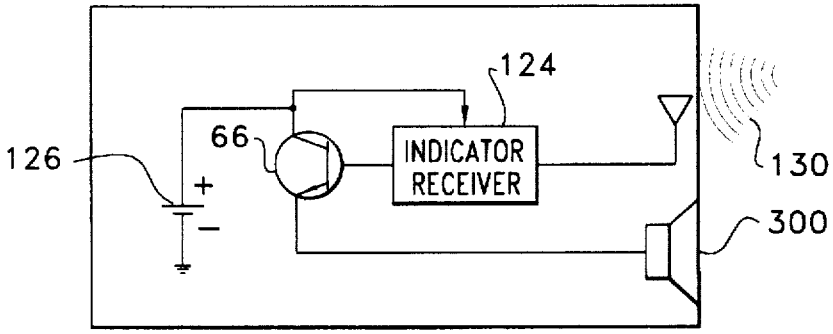
FIG. 21 is similar to FIG. 6 but with the multivibrator and the illuminator replaced with an annunciator.

As shown in FIG. 21 and as disclosed in application Ser. No. 08/524,006, the multivibrator 62 and the indication means 54 of the remotely-located indicator 480 and the parent units 590, 690, 790 and 890 can be replaced with a low volume annunciator 300 (e.g., Panasonic EFB-CB37C11 Ceramic Buzzer) for providing an audible indication to the parent or infant-caretaker that the gate 26 has been left in an open condition. The use of a low volume annunciator 300 assures that the infant will not be awakened by the audible sound, while providing the "open gate condition" alert to the parent or infant-caretaker. Activation of the annunciator 300 would be similar to activation of the multivibrator 62 and indication means 54 described above.

Although not shown, it is within the broadest scope of this invention to include a low voltage indicator in the gate sensor means 120B to indicate when the battery 60 needs to be replaced. Similarly, this scope includes a low voltage indicator in the remotely-located indicator 480 or the remote enabling means 420A when batteries, instead of AC power from the wall socket, are used for providing power.

Figure 3:
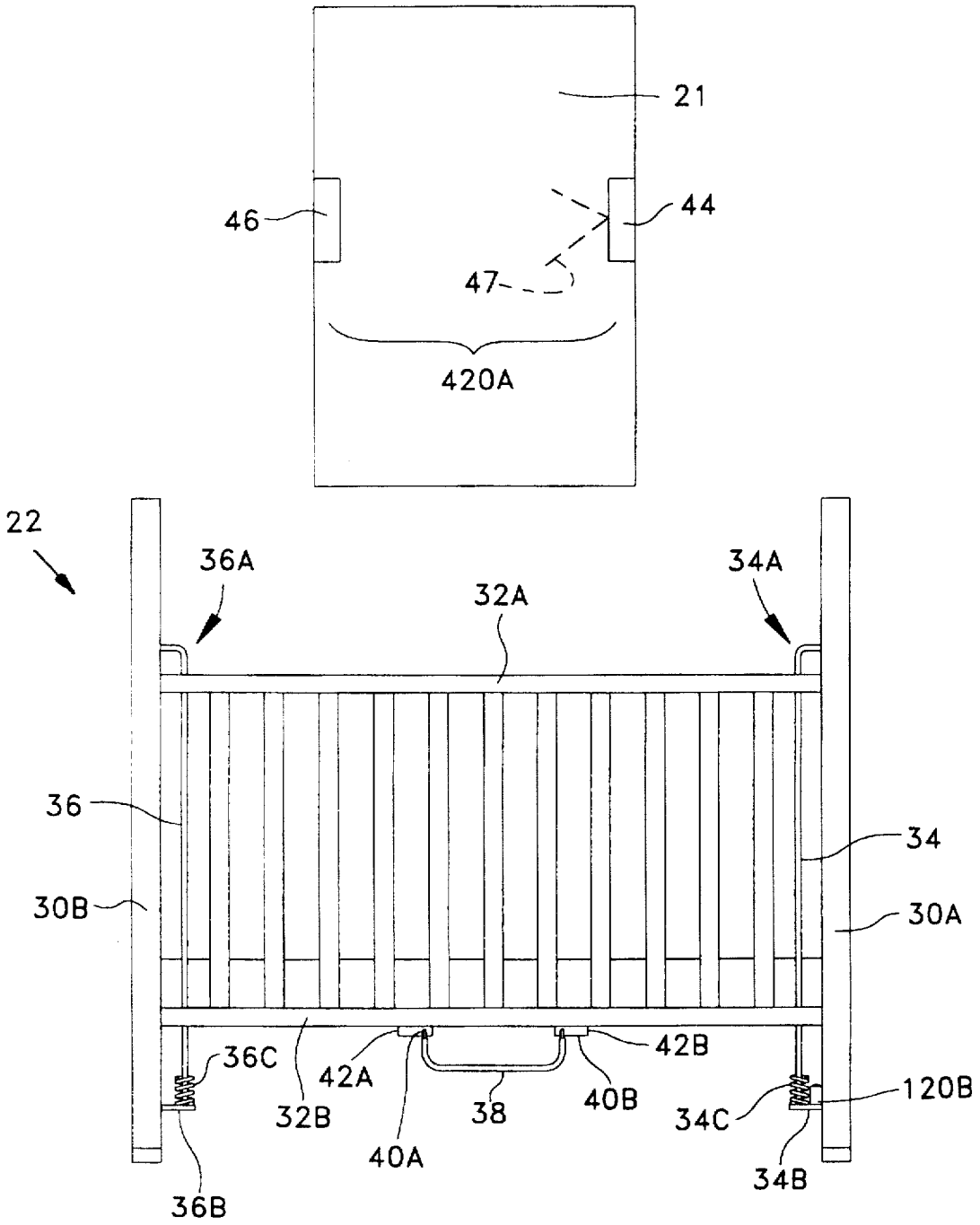
FIG. 3 is a side view of the crib with the gate sensor means coupled thereto and a view of the doorway with the enabling means coupled thereto.

As with application Ser. No. 08/524,006, it is also within the broadest scope of this invention to have the gate sensor means 120B (FIG. 7) be an integral portion of the crib 22, i.e., the crib gate switch 52 and the associated circuitry can be built into the crib frame rather than being contained within a housing 50 that is affixed to some portion of the crib 22 as shown in FIG. 3. However, the preferred embodiment of the gate sensor means 120B comprises a housing 50 to allow application of this invention to existing cribs.

Some conventional baby monitoring systems include a video portion that permits a video display, along with the audio information, of the baby in the crib to be monitored by the parent or infant-caretaker. It is within the broadest scope of this invention to include a crib gate position indicator that can operate in conjunction with that type of baby monitoring system also in accordance with details described above.

Without further elaboration, the foregoing will so fully illustrate our invention that others may, by applying current or future knowledge, readily adopt the same for use under various conditions of service.

We claim:

1. An apparatus for providing an automatic crib gate position indication of a crib having a gate that can be positioned in an open or a closed condition, said apparatus comprising a gate sensor means, having a transmitter, coupled to the crib that wirelessly transmits a first signal indicative of the open condition to a baby monitoring system, the baby monitoring system including a baby unit adjacent the crib and a parent unit remotely-located from the crib and whereby the baby unit wirelessly transmits a second signal indicative of the baby sounds that is received by said parent unit, said first signal being received by said parent unit and controlling a crib gate indication means therein.

2. The apparatus of claim 1 further comprising a remotely-located enabling means, said remotely-located enabling means enabling said gate sensor means whenever a person moves into the vicinity of the crib.

3. The apparatus of claim 1 further comprising a remotely-located enabling means for enabling said gate sensor means, said remotely-located enabling means being part of the baby unit and whereby said remotely-located enabling means is activated whenever the baby unit is turned on by activation of a baby unit power switch.

4. The apparatus of claim 3 wherein said parent unit comprises an indicator receiver within the parent unit for receiving said first signal for controlling said indication means, said indicator receiver being energized to receive said first signal whenever said parent unit is turned on by activation of a parent unit power switch.

5. The apparatus of claim 1 further comprising a remotely-located enabling means for enabling said gate sensor means, said remotely-located enabling means being part of the baby unit and whereby said remotely-located enabling means is electrically coupled to an enabling means power switch independent of a baby unit power switch, said remotely-located enabling means being activated by said enabling means power switch regardless of whether the baby unit power switch is on or off.

6. The apparatus of claim 5 wherein said parent unit comprises an indicator receiver that is electrically coupled to an indicator receiver power switch independent of a parent unit power switch, said indicator receiver being energized to receive said first signal by said indicator receiver power switch regardless of whether the parent unit power switch is on or off.

7. The apparatus of claim 1 wherein said indication means is an illuminator.

8. The apparatus of claim 1 wherein said indication means is an annunciator.

9. An apparatus for providing an automatic crib gate position indication of a crib having a gate that can be positioned in an open or a closed condition, said apparatus comprising a gate sensor means, having a transmitter, coupled to the crib that wirelessly transmits a first signal indicative of the open condition to a baby monitoring system, the baby monitoring system including a baby unit adjacent the crib and a parent unit remotely-located from the crib and whereby the baby unit includes a receiver for receiving said first signal and whereby said baby unit generates a second signal indicative of baby sounds sensed by said baby unit, said first signal being embedded into the second signal, by a modulation means in said baby unit coupled to said receiver, to form a composite signal that is wirelessly transmitted to, and received by, the parent unit and wherein said composite signal is used to control a crib gate indication means in said parent unit.

10. The apparatus of claim 9 wherein said parent unit comprises demodulation means for demodulating said composite signal into said first and second signals, said demodulation means being coupled to said crib gate indication means such that said first signal controls the activation of said crib gate indication means.

11. The apparatus of claim 10 further comprising a remotely-located enabling means, said remotely-located enabling means enabling said gate sensor means whenever a person moves into the vicinity of the crib.

12. The apparatus of claim 10 further comprising a remotely-located enabling means for enabling said gate sensor means, said remotely-located enabling means being part of said baby unit and whereby said remotely-located enabling means is activated whenever said baby unit is turned on by activation of a baby unit power switch.

13. The apparatus of claim 9 wherein said indication means is an illuminator.

14. The apparatus of claim 9 wherein said indication means is an annunciator.

15. An apparatus for use with a baby crib having a displaceable gate that can be positioned in an open condition or in a closed condition, said apparatus providing an automatic, remotely-located indication of the condition of the gate, said apparatus comprising:

gate sensor means, coupled to the crib, including a transmitter for wirelessly transmitting a gate indication signal representative of the open condition of the gate;

a remotely-located receiver including an indication means, said remotely-located receiver receiving said gate indication signal and said gate indication signal controlling the activation of said indication means;

remotely-located enabling means, said enabling means enabling said gate sensor means whenever a person moves into the vicinity of the crib; and said remotely-located enabling means and said remotely-located receiver being at respective locations remote from the crib.

16. The apparatus of claim 15 wherein said indication means is an illuminator.

17. The apparatus of claim 15 wherein said indication means is an annunciator.

* * * * *

UNITED STATES PATENT AND TRADEMARK OFFICE

CERTIFICATE OF CORRECTION

PATENT NO. : 5,757,274

DATED : May 26, 1998

INVENTOR(S) : Cynthia J. Slomowitz and Scott M. Slomowitz

It is certified that error appears in the above-identified patent and that said Letters Patent is hereby corrected as shown below:

On title page, item [76]

the inventors' CURRENT residence should be listed as follows:

-- 33 Maple Lane, Glen Mills, PA 19342 --

Signed and Sealed this

Fourteenth Day of July, 1998

Bruce Lehman

*Attest:*

BRUCE LEHMAN

*Attesting Officer*

*Commissioner of Patents and Trademarks*